US005518150A

United States Patent [19]

Witt, Jr.

[11] Patent Number: 5,518,150

[45] Date of Patent: May 21, 1996

[54] MULTI-CHAMBERED CONTAINER HAVING A TUBE INSERTION GUIDE WALL

[75] Inventor: Donald C. Witt, Jr., 1021 D Sibley St., Folsom, Calif. 95630

[73] Assignee: Donald C. Witt, Jr.

[21] Appl. No.: 374,350

[22] Filed: Jan. 18, 1995

[51] Int. Cl.[6] ..... B67D 5/40

[52] U.S. Cl. ..... 222/377; 222/382; 222/464.7

[58] Field of Search ..... 222/324, 377, 222/382, 383.1, 328, 584, 454, 464.1, 464.3, 464.7

[56] References Cited

U.S. PATENT DOCUMENTS 5,083,683 1/1992 Knickerbocker ..... 222/382
5,152,431 10/1992 Gardner et al. ..... 222/383.1 X
5,279,450 1/1994 Witt, Jr. ..... 222/377

FOREIGN PATENT DOCUMENTS 737905 10/1955 United Kingdom ..... 222/584

*Primary Examiner*—Kevin P. Shaver

[57] ABSTRACT

A liquid container having a threaded neck tapering into a multi-directional hand grip for easy handling. Both sides continue outward and down to the base, which allows the container to stand freely. Within the container a partition represented by a tube guide wall, starts at the base in the corner beneath the hand grip, and slants in an upward direction towards the neck portion creating two separate chambers. The top of the tube guide wall has a slight curve at the opening which ensures that the suction tube will be inserted into the small chamber, and also allows the two chambers to communicate fluid there between.

9 Claims, 2 Drawing Sheets

FIG. 6
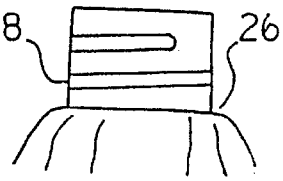
FIG. 2
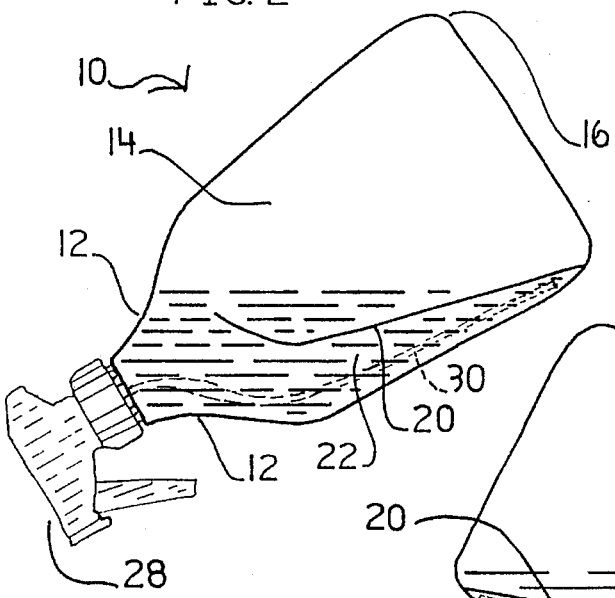
FIG. 4
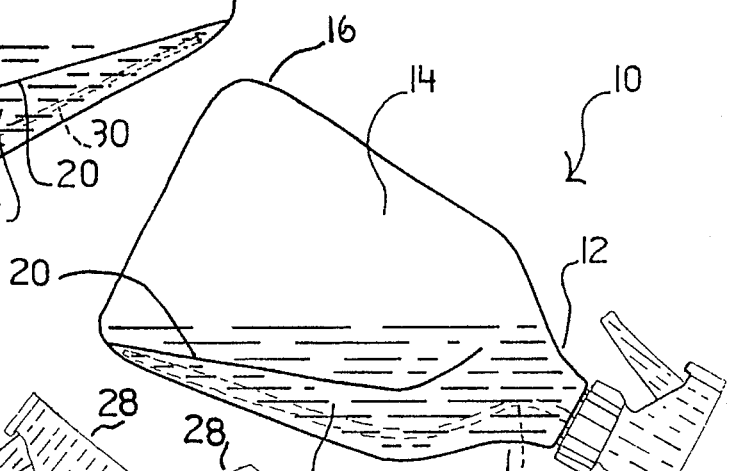
FIG. 3
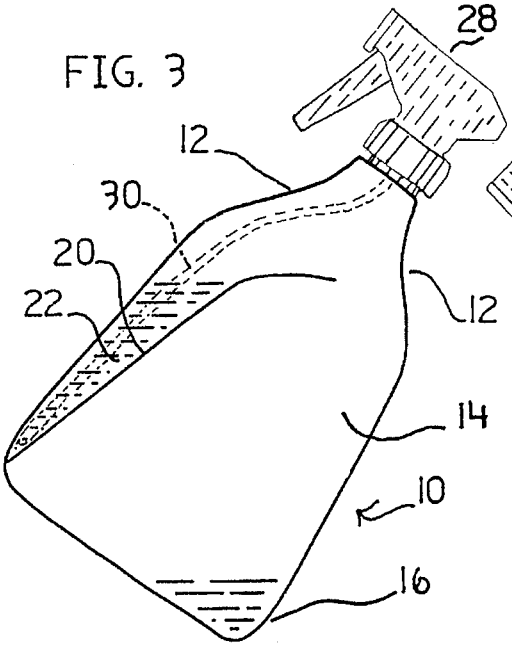
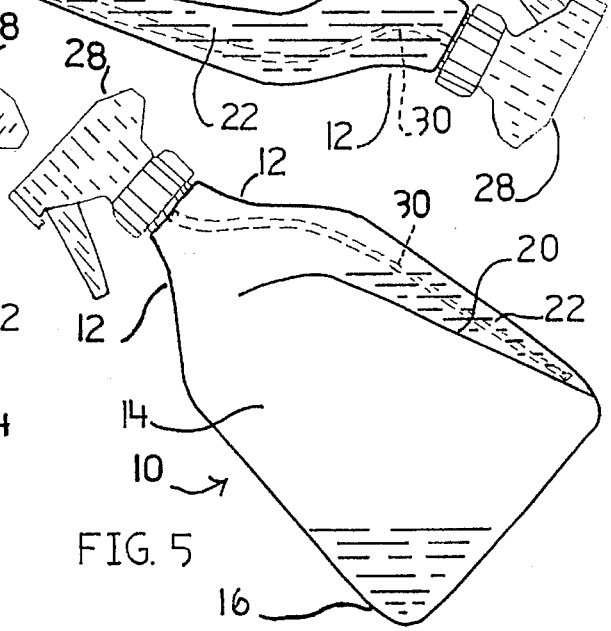
FIG. 5

MULTI-CHAMBERED CONTAINER HAVING A TUBE INSERTION GUIDE WALL

BACKGROUND

1. Field of the Invention

This Invention relates generally to manually operated pump type dispenser containers, and more particularly, to an improved container with a tube inserted guide wall making two separate chambers adapted for dispensing atomized fluid in a variety of positions, including an inverted position.

2. Description of Prior Art

Pump type fluid dispensers generally include a suction tube which extends into a container configured to hold the fluid to be pumped. The containers take on different shapes for comfort and style, such as those which use handgrips and non-slip surfaces, but all of the containers merely hold a fluid to be dispensed. The problem with such conventional containers is that the fluid level eventually reaches a point at which the suction tube begins to draw air, particularly when the container is tilted from a vertical position into a horizontal plane or when the container is inverted. When this happens the fluid will spew and sputter from the pump nozzle, rather than spray as it was intended. The spewing of fluid usually ends up dripping from the nozzle, possibly damaging clothing, furniture, rugs, and the like, depending upon the type of fluid being dispensed. Moreover, when the container is inverted, the suction tube sticks straight out of the fluid making it impossible to use.

My recently patented Container With Two Separate Chambers, patent No. 5,279,450 solves the problem of not being able to use 100% of the fluid within the container. The two problems with the design are as follows: the substantially curved flow restrictor will often times trap air bubbles in the smaller chamber when the container is used in the inverted position, which causes the dispenser to loose its prime. In addition the curved flow restrictor makes it virtually impossible for the automated equipment to attach the container to the dispenser while directing the suction tube into the correct smaller chamber.

Therefore, a need exists for a container which can be titled or inverted, while still maintaining the ability to dispense a fluid. The present invention fulfills that need.

OBJECTS AND ADVANTAGES

This invention pertains generally to a fluid container which can be used with a pump type dispenser in a variety of orientations. By way of example and not of limitation, the container of the present invention generally includes two chambers, one small and one large, which are adjacently disposed. A suction tube from a pump type dispenser extends into the small chamber for drawing fluid therefrom. The small chamber automatically fills with fluid whenever the container is oriented such that the water line of the large chamber is above the water line of the small chamber.

Accordingly several objects and advantages of my invention are the use of a pump type dispenser in the inverted position without the suction tube sucking air, thus causing the nozzle of the pump to sputter and spew fluid.

It is an object of the invention to provide complete consumption of the fluid to be pumped while maintaining a maximum degree of usage.

It is also the object of the invention to provide an apparatus for dispensing atomized fluid while in an inverted position when using the multi-directional hand grip, which allows the dispenser to be used comfortably in several positions.

Another object of the invention is to provide ample space for any automated equipment to directly insert the suction tube into the correct smaller chamber.

Another object of the invention is to provide an apparatus which can dispense the majority of the fluid in a container while in an inverted position.

Still another object of the invention is to provide an apparatus for dispensing atomized fluid having a simple, dependable fluid pickup means.

Further objects and advantages of my invention will become apparent from a consideration of the drawings and ensuing description.

BRIEF DESCRIPTION OF THE DRAWINGS

The invention will be more fully understood by reference to the following drawings which are for illustrative purposes only:

FIG. 2 is a diagrammatic side elevation of the apparatus of FIG. 1 showing the small chamber being filled with fluid when the container is inverted, and the position of the manual trigger type dispenser is facing towards the small chamber.

FIG. 3 is a diagrammatic side elevation of the apparatus of FIG. 1 showing the fluid levels in the small and large chambers when the container is oriented for spraying in an upward position and the position of the manual trigger type dispenser is facing towards the small chamber.

FIG. 4 is a diagrammatic side elevation of the apparatus of FIG. 1 showing the fluid levels in the small and large chambers when the manual trigger type dispenser faces away from the small chamber, yet the container is oriented for spraying in an upward position.

FIG. 5 is a diagrammatic side elevation of the apparatus of FIG. 1 showing the fluid levels in the small and large chambers when the manual trigger type dispenser faces away from the small chamber, while the user can still spray in a downward direction.

FIG. 6 is a side close-up elevation of the conventional threading around the neck portion of the container.

Figure 1:
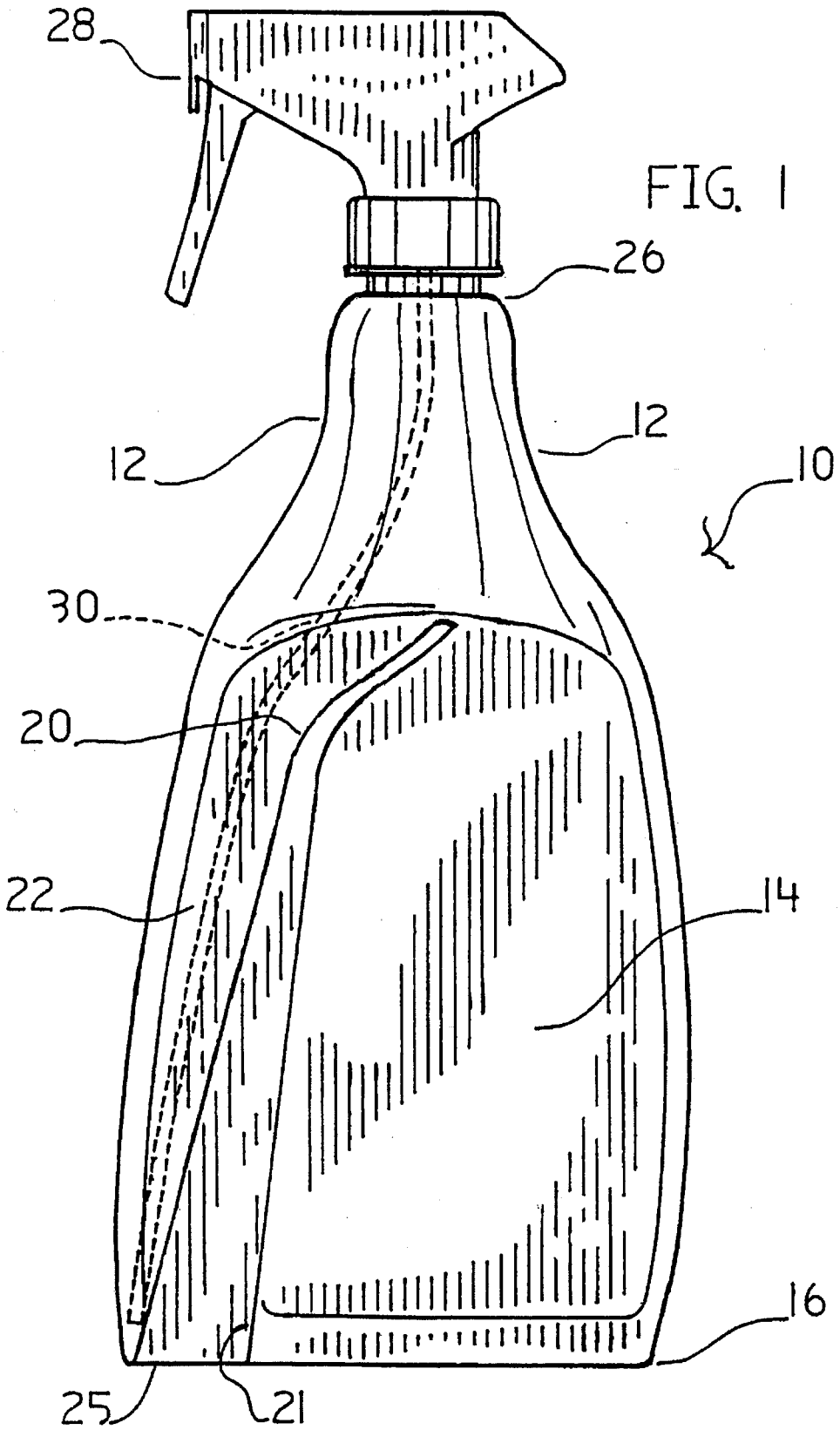
FIG. 1 is a side elevation of a container with a suction tube retrieval wall according to the present invention.

| Reference Numerals In Drawings | |
|---|---|
| 10. container with suction tube retrieval wall | 21. cavity |
| 12. multi-directional hand grips | 22. small chamber |
| 14. large chamber | 25. support member |
| 16. base | 26. neck portion |
| 18. conventional threads | 28. trigger type dispenser |
| 20. tube retrieval wall | 30. suction tube |

DESCRIPTION 1 TO 6

Referring more specifically to the drawings, for illustrative purposes the present invention is embodied in the apparatus generally shown in FIG. 1. It will be appreciated that the apparatus may vary as to configuration and as to details of the parts without departing from the basic concepts as disclosed herein.

A typical embodiment of the container with a suction tube insertion guide wall in accordance with the present invention is shown at 10 in FIG. 1 as comprising a neck portion 26 with an opening and a conventional type of threading 18 tapering into a multi-directional hand grip 12 which allows the user a number of positions for use. Below the multi-directional hand grip 12 the container 10 tapers outward and down having two relatively wide walls which wrap around making two relatively narrow walls closing off the container 10 with a base 16 allowing the container 10 to stand upright. The container 10 of the present invention has both a vertical axis and a horizontal axis, the vertical axis extending between the neck portion 26 and the base 16, while the horizontal axis extends between the two relatively wide walls. Within the container 10 a partition means serves to partially divide container 10 into first and second chambers. In the preferred embodiment, one chamber is small 22 and the other is large 14. A preferred embodiment for a partition means represented by a tube insertion guide wall 20 which begins at the base 16 in the very most corner, and slants in an upward direction towards the neck portion 26 at approximately 70 degrees, although several other angles may be used. The tube insertion guide wall 20 ends just below the multi-directional hand grips 12 with a slight curve towards the relatively narrow wall of the container 10, allowing enough space for automated equipment to direct a suction tube 30 into the smaller of the two chambers 22. The tube insertion guide wall 20 has a complete seal with the two relatively wide walls of the container 10 from the base 16 to the neck portion 26 area creating a completely separate small chamber 22 with one opening just below the multi-directional hand grips 12 which allows the communication of fluid there between a large chamber 14 and the small chamber 22.

Referring to FIG. 1, the present invention is shown in a form which is most practicable for blow molding as a means of fabrication. In this Figure the suction tube insertion guide wall 20 serves as a partition means to separate the two chambers, 14 and 22, is replaced with a cavity 21. Cavity 21 extends upward along the vertical axis of container 10, cavity 21 preferably penetrating in a horizontal fashion, bath of the wide walls of container 10 throughout its vertical path. In this way, cavity 21 defines a space separating the two chambers 14 and 22. Cavity 21 has an open end near base 16 and an opposing closed end at the top. In the preferred embodiment, the closed end of cavity 21 has a slightly curved portion serving as a guide for the suction tube 30, acting as the tube insertion guide wall 20, when using automated equipment, that the suction tube 30 be directed into small chamber 22. This slight curve at the closed end of the tube insertion guide wall 20 allows air to travel from the small chamber 22 to the large chamber 14 when using the container 10 and the small chamber 22 is in a downward position, as shown in FIG. 2 and 4. At its opposing open end, cavity 21 terminates at a point such that the two chambers 14 and 22 are partially separated. The closed end of cavity 21 or top of tube insertion guide wall 20, in this way, then allows open communication to remain between chambers 14 and 22, enabling fluid to flow back and forth between the two chambers 14 and 22.

Referring to FIG. 1, the space defined by cavity 21 preferably has a rigid support member 25 spanning cavity 21 at a central location parallel with the wide walls of container 10, thus making tube insertion guide wall 20.

A suction tube 30, from a dispensing means, which is preferably a manually operated trigger type dispenser 28, is placed inside of the small chamber 22, and proceeds down towards the base 16. Suction tube 30 provides small chamber 22 with fluid pickup means having a simple, trouble free design. The manually operated trigger type dispenser 28 has preferably an internally threaded cap portion, which allows it to communicate with neck portion 26, and preferably be detachably connected to the neck portion 26 of the container 10. This detachable portion of the manual trigger type dispenser 28 is to be loosened to enable to dispenser to swivel in a 360 degree manner; the user re-tightens the cap of the manual trigger type dispenser 28 when swiveled into the desired position. The manually operated trigger type dispenser 28 preferably atomizes fluid in container 10 upon dispensing.

The container 10 may be injection molded in two halves (to be suitably bonded to each other) from a plastic material.

The container 10 is made to store the fluid that is to be pumped by a manually operated trigger type dispenser 28 as shown in FIG. 1 the suction tube 30 from the trigger type dispenser 28 travels down and is retrieved into the small chamber 22 by the tube insertion guide wall 20. The neck portion 26 of the container 10 has an externally threaded portion 18, as shown in FIG. 6, which can be put into a screw engagement with the cap of the trigger type dispenser 28, thus providing and airtight seal. The atomizing direction of the trigger type dispenser 28 can be used in 360 degree directions, by simply loosening the screw engagement of the cap and swiveling the trigger type dispenser 28 to the desired position. The multi-directional hand grips 12 used in conjunction with the manual trigger type dispenser 28 allow many comfortable and controlled positions while in use. The insertion guide wall 20 within the container 10 provides a separate small chamber 22 to hold fluid and allow air to escape from the small chamber 22 when the container 10 is in the inverted position. To fill the small chamber 22 the user must simply roll their wrist forward turning the container 10 in an upside down direction towards the small chamber 22 and then back to an upright position as shown in FIG. 2 and 3. This process allows a maximum degree of usage until the fluid is completely gone. To enable the user to spray in an upward direction, FIG. 4 and 5 illustrate the manual trigger type dispenser 28 filling the small chamber 22 by rolling wrist in backward direction while manual trigger type dispenser 28 is facing away from small chamber 22. For the user to spray in an upward direction, FIG. 4 and 5 illustrate the importance of the multidirectional hand grips 12 when used in conjunction with the swivel of the cap, of the manual trigger type dispenser 28, by simply loosening the screw engagement of the cap, and retightening the cap, when the manual trigger type dispenser 28 is in the desired position.

Inverted use of the trigger type dispenser 28 using the container 10 with two chambers 14 and 22, is possible due to natural air pressure inside of the container 10. As long as the fluid, when the container 10 is inverted, does not go below the opening of the small chamber 22, the fluid will be drawn from the large chamber 14, into the small chamber 22, where the suction tube 30 of the trigger type dispenser 28 sucks the fluid to be pumped. When the fluid gets too low for inverted use, the small chamber 22 will fill with air, at this time the user should refill the small chamber 22 as shown in FIGS. 2 and 3, and when trigger type dispenser 28 is facing away from small chamber 22 as shown in FIGS. 4 and 5.

The length of the tube insertion guide wall 20, is in direct relation with how long inverted use may be achieved. Following the refilling of the small chamber 22 the trigger type dispenser 28 should only be used to spray in a downward to an upward position, this may be achieved until the fluid is completely gone.

SUMMARY, RAMIFICATIONS, AND SCOPE

Accordingly it will be seen that the small chamber of the invention provides the user of the container with a highly reliable, economical way to use all of the fluid with a maximum degree of usage.

It should be noted that many other variations are possible. For example, the size and shape of the container, or the length, angle and the position of the open and closed end of the tube insertion guide wall or cavity, can vary without departing from the invention disclosed herein.

Although the description above contains many specificities, these should not be construed as limiting the scope of the invention but as merely providing illustrations of some of the presently preferred embodiments of this invention. Thus the scope of this invention should be determined by the appended claims and their legal equivalents.

I claim:

1. A fluid dispenser, comprising:

a) dispensing means for dispensing a fluid;

b) containment means for holding a fluid, said containment means having a vertical axis and a horizontal axis, said containment means including a neck portion, said neck portion coupled to said dispensing means;

c) a partition means for dividing said containment means into a first chamber and a second chamber and allowing said first chamber to communicate with said second chamber;

d) said partition means including a tube insertion wall means for guiding the entrance of a suction tube into said first chamber; and e) said suction tube having first and second ends, said suction tube coupled to said dispensing means at said first end, said suction tube communicating with said first chamber at said second end.

2. A fluid dispenser as recited in claim 1, wherein said partition means further comprises:

a) a cavity, said cavity extending along said vertical axis of said containment means, said cavity having a first closed end and a second open end;

b) said cavity penetrating horizontally through said containment means along said vertical axis of said containment means for a distance extending between said open and closed ends of said cavity, said cavity defining a space between said first chamber and said second chamber;

c) said cavity including a curve at said closed end which defines said tube insertion wall means;

d) said partition being shaped to allow air to flow from said first chamber to said second chamber.

3. A fluid dispenser as recited in claim 2, further comprising a support member, said support member spanning said cavity at a central location.

4. A fluid dispenser as recited in claim 3, wherein said containment means further comprises a multi-directional hand grip section, said multi-directional hand grip section being positioned below said dispensing means.

5. An apparatus for dispensing fluid, comprising:

a) manually operated dispensing means for dispensing atomized fluid;

b) a container, said container having a vertical axis and a horizontal axis, said container having a neck portion for communicating with said dispensing means;

c) partition means for partially dividing said container into a first chamber and a second chamber and allowing said first chamber to communicate with said second chamber;

d) said partition means including a curve at its upper end for defining on tube insertion guide wall for guiding a suction tube into said first chamber; and e) said suction tube having first and second ends, said suction tube coupled to said dispensing means at said first end, said suction tube communicating with said first chamber at said second end.

6. An apparatus as recited in claim 5, wherein said partition means further comprises:

a) a cavity, said cavity extending along said vertical axis of said container, said cavity having first closed end and a second open end;

b) said cavity penetrating horizontally through said container along said vertical axis of said container for a distance extending between said open and closed ends of said cavity, said cavity defining a space between said first chamber and said second chamber.

7. An apparatus as recited in claim 6, further comprising a support member, said support member spanning said cavity at a central location.

8. An apparatus as recited in claim 7, wherein said container further comprises a multi-direction hand grip section, said multi-directional hand grip section being positioned below said dispensing means.

9. An apparatus for dispensing atomized fluid, comprising:

a) manually operated dispensing means for dispensing fluid;

b) a container, said container having a vertical axis and a horizontal axis, said container including a neck portion for communicating with said dispensing means;

c) said container including a multi-directional hand grip section, said multi-directional hand grip section being positioned below said dispensing means;

d) partition means for partially dividing said container into a first chamber and a second chamber and allowing said first chamber to communicate with said second chamber;

e) said partition means including a tube insertion wall having a curve at its upper end for guiding a suction tube into said first chamber;

f) said suction tube having first and second ends, said suction tube coupled to said dispensing means at said first end, said suction tube communicating with said first chamber at said second end.

* * * * *